US011370509B1

(12) United States Patent
Haas

(10) Patent No.: US 11,370,509 B1
(45) Date of Patent: Jun. 28, 2022

(54) COMBINED TROLLING MOTOR PEDAL RECESS AND SEAT PEDESTAL DRAIN TRENCH

(71) Applicant: Benjamin S. Haas, Ottsville, PA (US)

(72) Inventor: Benjamin S. Haas, Ottsville, PA (US)

( * ) Notice: Subject to any disclaimer, the term of this patent is extended or adjusted under 35 U.S.C. 154(b) by 10 days.

(21) Appl. No.: 16/817,165

(22) Filed: Mar. 12, 2020

Related U.S. Application Data

(60) Provisional application No. 62/817,233, filed on Mar. 12, 2019.

(51) Int. Cl.

| | |
|---|---|
| ***B63B 13/00*** | (2006.01) |
| ***B63B 3/70*** | (2006.01) |
| ***B63B 5/24*** | (2006.01) |
| *B63H 20/00* | (2006.01) |

(52) U.S. Cl.
CPC ..... *B63B 13/00* (2013.01); *B63B 3/70* (2013.01); *B63B 5/24* (2013.01); *B63H 20/007* (2013.01)

(58) Field of Classification Search
CPC ..... B29C 48/09; B63B 13/00; B63B 13/02; B63B 3/70; B63B 5/24; B63B 3/54; B63B 19/26; B63B 19/22; B63H 20/007
USPC ..... 114/357
See application file for complete search history.

(56) References Cited

U.S. PATENT DOCUMENTS

| | | | | |
|---|---|---|---|---|
| 3,790,977 | A * | 2/1974 | Bombardier | B63B 1/04 114/357 |
| 6,024,042 | A * | 2/2000 | Eilert | B63B 13/00 114/355 |
| 2014/0020612 | A1* | 1/2014 | Lizzio | B63B 34/10 114/55.56 |
| 2014/0299219 | A1* | 10/2014 | Coleman | B29C 41/20 138/140 |

OTHER PUBLICATIONS

Troll-Eze, www.troll-eze.com, retrieved by the examiner from the internet on Aug. 2, 2021, Archived screen capture dated Nov. 4, 2015. (Year: 2015).*

* cited by examiner

*Primary Examiner* — Anthony D Wiest
(74) *Attorney, Agent, or Firm* — Wilkinson Law Office; Clinton H. Wilkinson

(57) ABSTRACT

An article of manufacture including molded-in cavities that permit the installation of recessed trolling motor foot pedals and seat pedestal bases in such a manner that allows water to drain away from thereof so as to prevent the accumulation of standing water. The article of manufacture includes a body, wherein the body is a plastic molded boat hull comprised of numerous molded-in cavities and molded-in features to create an interior layout that is comparable to a conventional boat built of aluminum or fiber reinforced plastic.

18 Claims, 6 Drawing Sheets

COMBINED TROLLING MOTOR PEDAL RECESS AND SEAT PEDESTAL DRAIN TRENCH

CROSS-REFERENCE TO RELATED APPLICATION

This application claims the benefit of U.S. Provisional Patent Application Ser. No. 62/817,233 filed on Mar. 12, 2019, the entirety of which is now incorporated herein by reference.

FIELD OF THE INVENTION

The present invention relates to systems and methods for the construction of rotational molded plastic-hulled power boats, and more particularly to the drainage of water from recessed areas in the deck of rotational molded power boat hulls.

BACKGROUND OF THE INVENTION

In the pursuit of applying rotational molding to the construction of plastic-hulled power boats, there are certain unique problems inherent to rotational molding that must be surmounted in order to make rotational molded plastic-hulled power boats that can compete on quality, performance, and price with conventional power boats constructed of aluminum or fiber reinforced plastic (FRP). One of these problems concerns the drainage of water from recessed areas in the deck, namely trays and/or cavities for the recess mounting of trolling motor foot pedals and seat pedestal bases that contain a recessed bushing for accepting the seat post.

In conventional aluminum and FRP boat construction, recessed structures and seat pedestals can be installed on top of the deck structure. Because aluminum and FRP boat construction are able to have a void space beneath the deck structure that is in communication with the bilge, any water that ingresses through holes or cavities in the deck structure is able to fall into the void space and ultimately to the bilge. In a rotational molded boat, however, there is no such void space beneath the molded plastic body to permit the drainage of water since the molded plastic body is a sealed, hollow shell of plastic. In addition, the interior of the hollow plastic body tends to be required to be filled completely with foam, or the geometry is such that cutting into the molded shell to run drain tubes is not feasible. If drainage from recessed areas in the deck and seat pedestal bases is not achieved, then standing water will accumulate in these areas and degrade both the function of the associated equipment and value of the boat. Alternatively, if no solution is utilized and the trolling motor foot pedals are placed on top of the deck and no seat pedestals are installed, then the performance and value of the boat is further lowered compared to aluminum and FRP alternatives. One theoretically possible solution is to install a complicated system of pipes and tubes within the molded plastic body, either via molded-in inserts or by cutting open the molded plastic shell, but this solution is not satisfactory as it is excessively complex compared to the relatively simple methods used by aluminum and FRP boats to solve the same problem.

This problem must be viewed in terms of the reasons for using rotational molding as an advantageous alternative to aluminum and FRP construction. The primary advantage of using rotational molding for the construction of power boat hulls is the drastic reduction in labor required to create hydrodynamic hulls with compound curvature. These hull characteristics are otherwise only achieved with FRP, while aluminum boat construction is practically restricted to flat panels and substantially simpler curvature. In rotational molding, when the sealed mold is filled with powdered plastic and placed in the oven, the oven does the work of molding the hull, not teams of welders, nor fiberglass workers laying mat and rolling resin. An additional advantage of using rotational molding for the construction of power boat hulls is the ability to include numerous molded-in longitudinal and transverse structures that provide both global and local structural reinforcement of the hull and decks, and create numerous compartments for storage, thereby avoiding the need for elaborate pre-fabricated decks that FRP and aluminum must use.

If rotational molded power boats are to compete on quality and performance against conventional boats made of aluminum or FRP, they must be able to have both recessed trolling motor pedals and seat pedestal bases that have proper drainage of standing water. In addition, if rotational molded power boats are to compete in price against conventional boats constructed of aluminum or FRP, they must be able to achieve these properly drained recessed trolling motor pedals and seat pedestal bases without resorting to excessively complex and/or costly fabricated solutions. Recognizing that the key economic advantage of rotational molding over aluminum or FRP construction is the ability to mold the hull and deck-supporting structure as one integral piece of plastic, the present invention provides a system and method for achieving both the installation of recessed cavities for trolling motor pedals and seat pedestal bases, and the drainage of water therefrom, without cutting open the molded plastic, using pre-fabricated decks, or relying on molded-in drainage tubes.

SUMMARY OF THE INVENTION

The present invention relates to a generic power boat hull that is rotational molded out of plastic, utilizing a combination of numerous male cavities, kiss-offs and other molded-in features integral with the hull to create an interior layout that is comparable to that of a conventional boat built of aluminum or FRP. The extensive use of the aforementioned molded-in features avoids the need for elaborate pre-fabricated decks, and avoids the need to cut into the molded hull to run cables, hoses, etc., thereby preserving the labor savings inherent to rotational molding a boat hull versus aluminum or FRP construction. In the present invention, this includes several molded-in male cavities designed specifically to facilitate the installation of recess-mounted trolling motor pedals and seat pedestal bases.

A particular side-effect of the aforementioned molded-in trolling motor and seat pedestal base cavities is that standing water will accumulate in these cavities since they are substantially lower than the surrounding deck structure and are too low to tie into the drain channels surrounding the molded-in compartments. In order to drain water away from these male cavities without using prefabricated decks or cutting into the molded plastic shell, the aforementioned molded-in male cavities are placed in-line with each other and are connected via a molded-in trench. This trench allows the water that accumulates in the cavity for the trolling motor pedal to drain aft into the cavity that is for the seat pedestal base. Furthermore, the molded-in trench continues aft from the seat pedestal base and terminates in an opening where the water can flow out of the trench and make its way to the bilge.

Further areas of applicability of the present invention will become apparent from the detailed description provided hereinafter.

BRIEF DESCRIPTION OF THE DRAWINGS

The present invention will become more readily understood from the detailed description in conjunction with the accompanying drawings, wherein like reference numerals designate like structural elements, and wherein.

DETAILED DESCRIPTION

Reference will now be made in detail to representative embodiments of the present invention as illustrated in the accompanying drawings. The following descriptions are not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
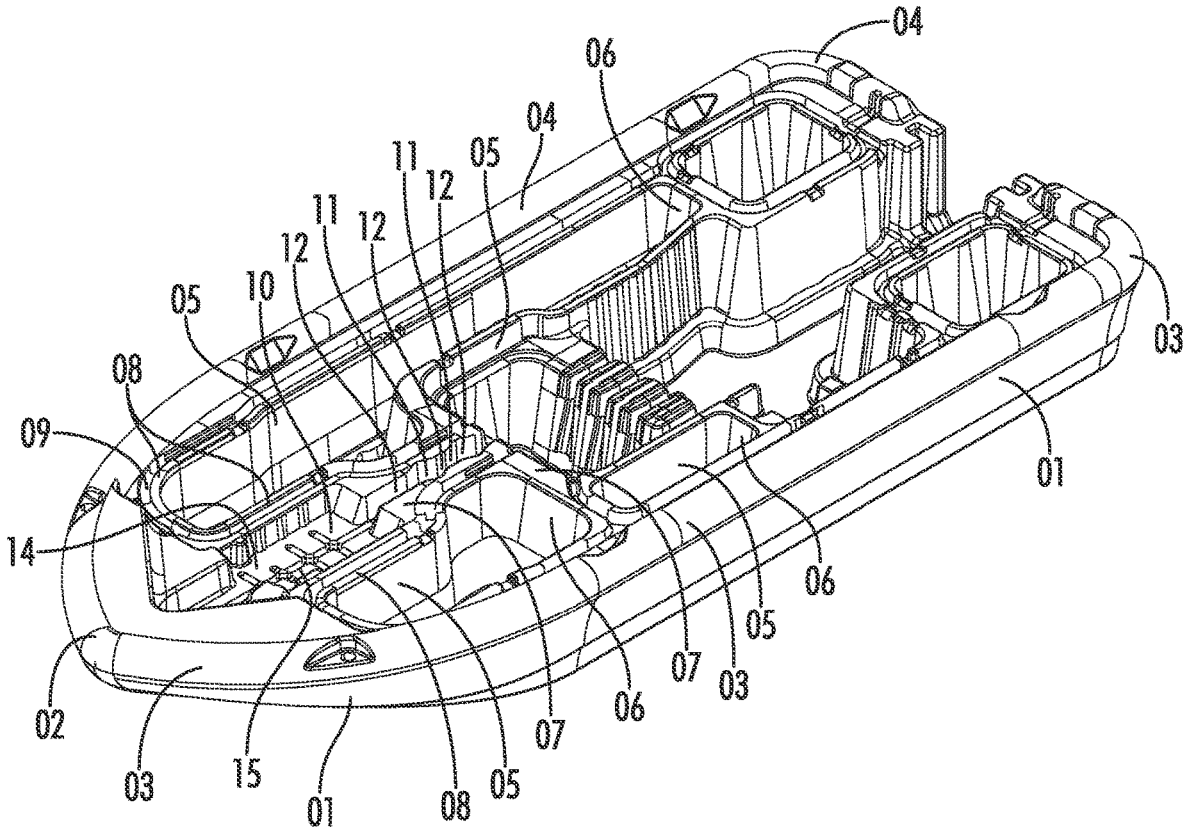
FIG. 1 is a isometric view of a generic rotational molded fishing boat containing the molded-in features and male cavities of the present invention.

With further reference to the drawings, a generic rotational molded fishing boat is depicted in FIG. 1. The rotational molded fishing boat utilizes numerous male cavities, kiss-offs, and various molded-in features to achieve an internal layout of close similarity to that of boats built of aluminum or FRP. The rotational molded boat illustrated in FIG. 1 can be manufactured from various materials suitable for the rotational molding process but would typically be made of polyethylene plastic.

As shown in FIG. 1, the boat includes an outer hull indicated generally by the numeral 01, with the bow portion of the hull 01 indicated by numeral 02, the port gunwale indicated by numeral 03, and the starboard gunwale indicated by numeral 04. Molded-in longitudinal vertical walls are indicated generally by numeral 05, and molded-in transverse vertical walls are indicated generally by numeral 06. These vertical walls 05 and 06 define the boundaries of the various molded-in male cavities. Molded-in horizontal flat surfaces located between or adjacent to one or more of the molded-in features are indicated generally by numeral 07 and provide both structural support and mounting surfaces for deck panels. Molded-in raised lips indicated generally by reference number 08 and cavities indicated generally by reference numeral 09 extend around the perimeters of the various male cavities and form drain channels around said male cavities. Cavities 09 are at a lower elevation than the associated lip 08. These drain channels formed by raised lips 08 and cavities 09 collect water flowing off of the deck structure and channel it aft towards the bilge. Any deck surface that is lower than the drain channels must have its own dedicated drainage system in order for water to properly drain from the surface.

In the present invention, the male cavity that accommodates the flush mounting of a trolling motor pedal is indicated generally by numeral 10, and the male cavities for the seat pedestal bases are indicated generally by numeral 11. In the illustrated embodiment the trolling motor pedal cavity 10 is positioned in the forward deck portion 02 of the boat hull 01, at a central location between the port gunwale 03 and the starboard gunwale 04. The cavities 11 for the seat pedestal bases are also positioned on the forward deck portion directly behind and in longitudinal alignment with the trolling motor pedal cavity 10. The cavities 10 and 11 also may have the same depth. It will be understood that the location of the cavities 10 and 11 is with respect to the usual course wherein the trolling motor pedal is located in front of the seat pedestal such that the pedal may be operated by the user's foot while the boat is moving forwardly; however, other possible orientations may be provided while still falling within the intended scope of the present invention.

Figure 2:
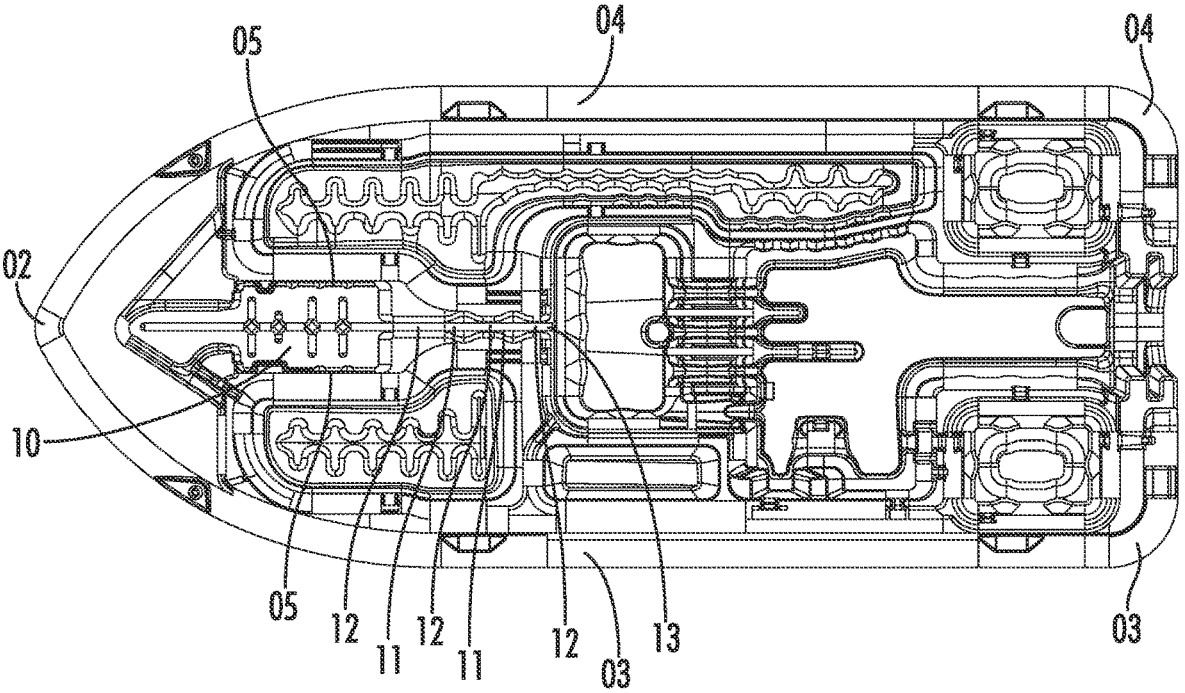
FIG. 2 is a top plan view of the rotational molded fishing boat in FIG. 1.

In FIG. 2, a plan view of the boat from FIG. 1 is depicted. The trolling motor cavity 10 and seat pedestal base cavities 11 are connected by a trench indicated generally by numeral 12 which allows water in any of the cavities 10 and 11 to drain aft to a lower point in the boat. The termination of the drain trench 12 where the water leaves the trench 12 and is free to flow to the bilge is indicated generally by numeral 13.

Figure 3:
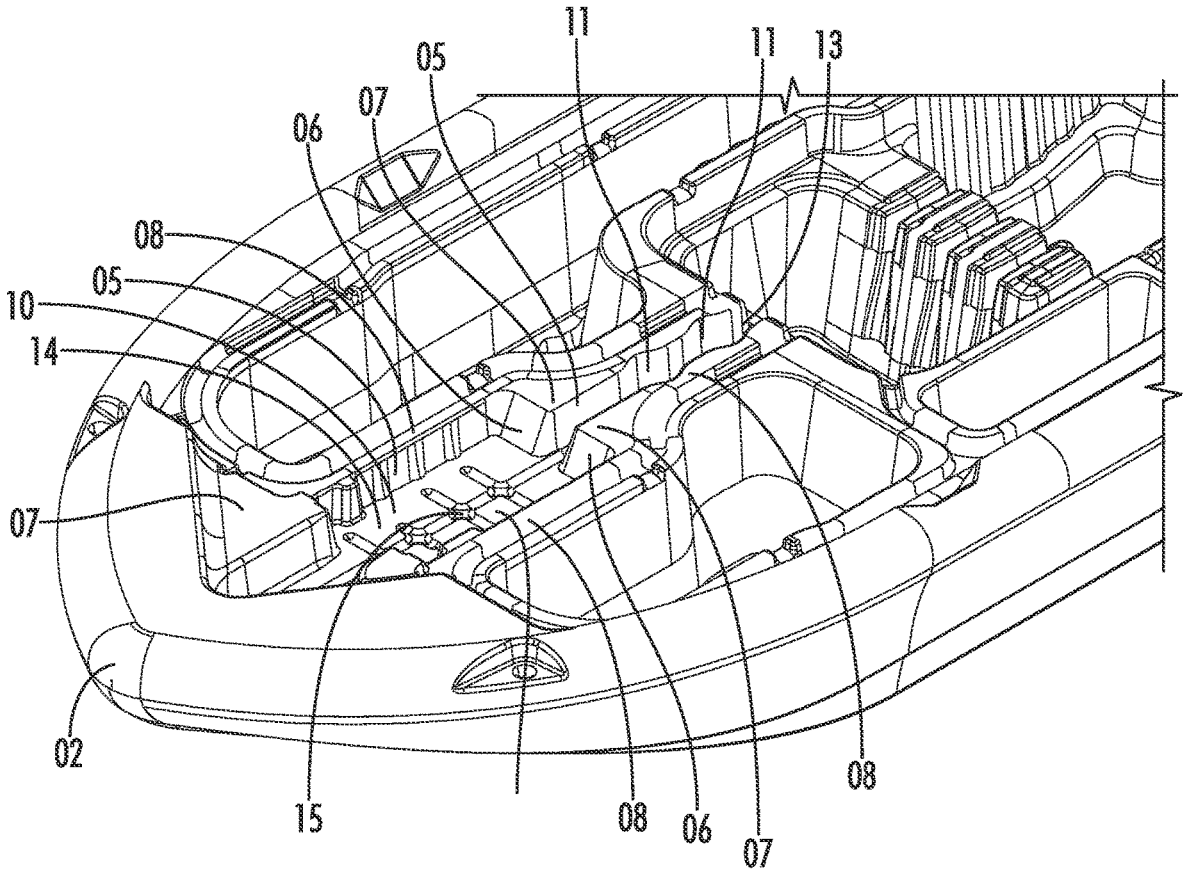
FIG. 3 is an isometric close-up view of the bow and forward deck portion of the boat showing the male cavities and trenches for the recessed trolling motor pedal and seat pedestal bases, looking from the port bow to the starboard quarter.

In FIG. 3, an isometric view of the bow and forward deck portion 2 of the boat from FIG. 1 is depicted, showing in greater detail the various aspects of the present invention. Both the cavity 10, for the trolling motor pedal, and the cavities 11, for the seat pedestal bases, are defined by a combination of molded-in longitudinal walls 05 and molded-in transverse walls 06. In addition, the combination of drain channel lips 08 and horizontal flat surfaces 07 bordering the cavities and trenches of the present invention support the deck panels around the present invention. The molded-in horizontal flat surface of the male cavity 10 for the recessed trolling motor pedal is indicated generally by numeral 14. This horizontal flat surface 14 continues aft and forms a continuous bottom surface with the seat pedestal base cavities 11, and the drain trench 12. The structure indicated generally by numeral 15 is a generic molded-in rib to add stiffness to the otherwise flat surface of 14.

Figure 4:
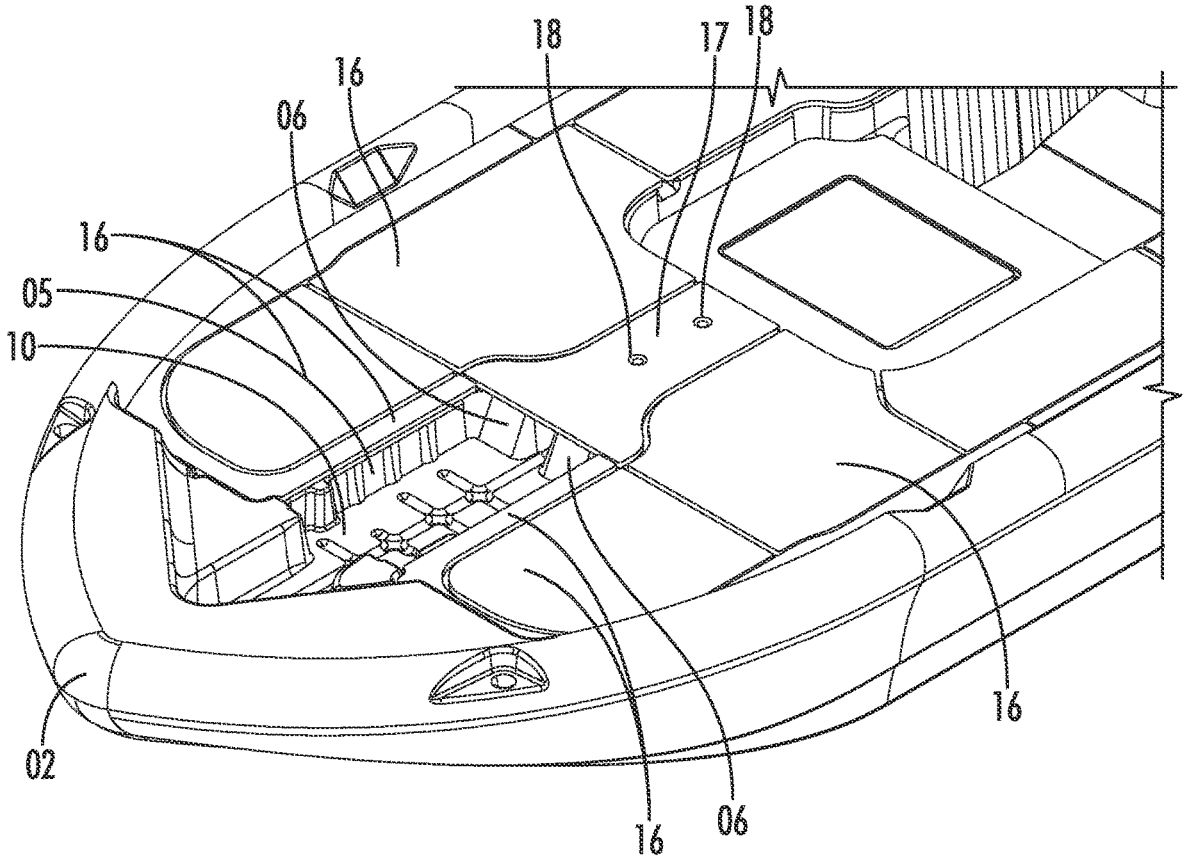
FIG. 4 is the same view as in FIG. 3 but having deck panels installed over the tops of the molded-in deck structure to demonstrate the recessed nature of the molded-in features.

In FIG. 4, the same isometric view as in FIG. 3 is depicted, but with deck panels shown installed over the horizontal flat surfaces. The deck panels are represented generally by the numeral 16, whereas the deck panel directly on top of the male cavities 11 for the seat pedestals is represented generally by the numeral 17. This deck panel 17 has two holes 18, each of which will receive one of the seat pedestal bases. The drain channels formed by raised lips 08 and adjacent cavities 09 are positioned and are such a width that the gap between adjacent deck panels 16 and/or 17 allows water to fall into the drain channels. The width of each individual cavity 09 of the drain channels is determined by various factors and the deck panels 06 and 07 are then sized for the particular drain channel.

Figure 5:
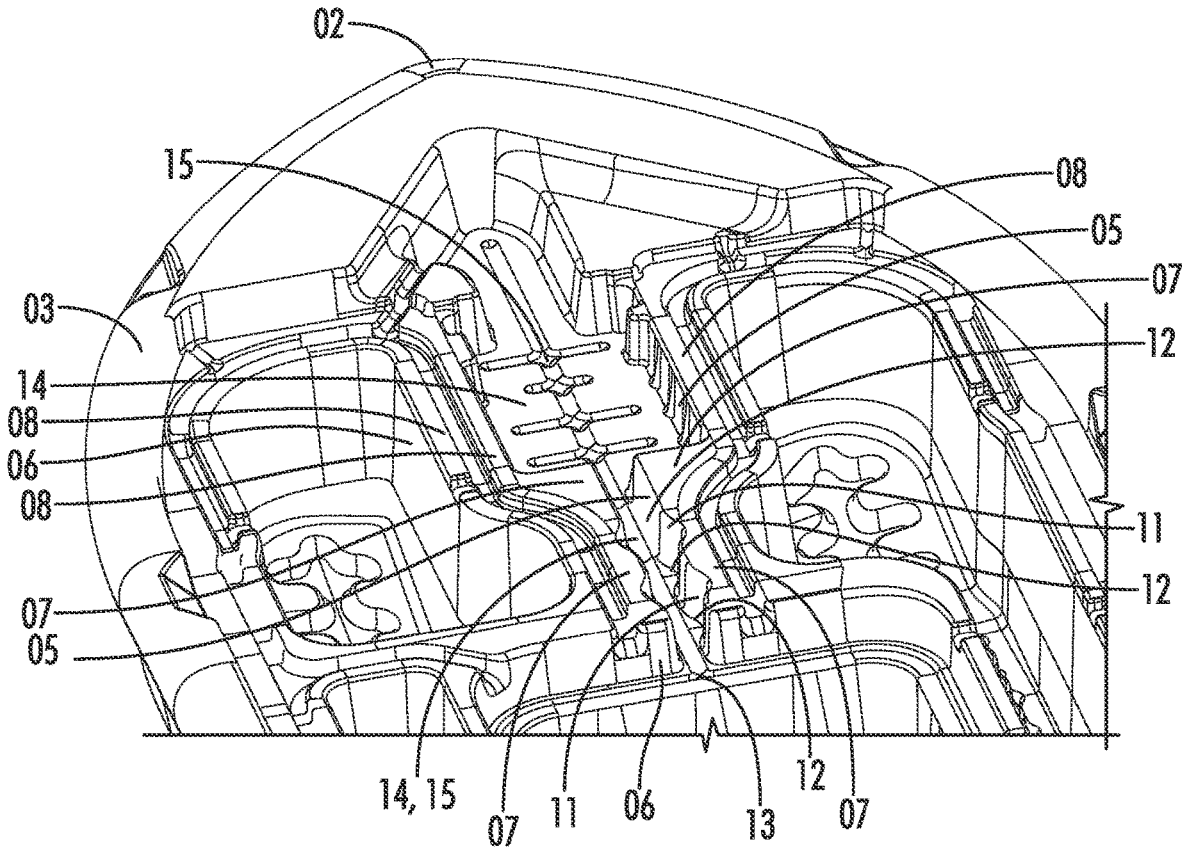
FIG. 5 is another isometric close-up view of the bow and forward deck portion of the boat showing the aforementioned features from FIG. 3, looking from aft to forward.

In FIG. 5, an isometric view of the bow and forward deck is depicted, this time from aft looking forward. In this view, the bottom surface of the combined drain trench 12 is more apparent as well as the structure of the longitudinal vertical walls 05 that comprise the male cavities 10 and 11 and drain trench 12. From this view, it is apparent that both the male cavity 10 for the trolling motor pedal and the male cavities 11 for the seat pedestal bases are in communication with each other via the molded-in trench 12 and any water that enters either cavity 10 or 11 is free to drain aft and out of the trench 12 via the opening 13. In effect, a combined trolling motor pedal recess and seat pedestal drain trench is formed. In an embodiment, one male cavity 11 may be provided; however, two male cavities 11 are provided in the illustrated embodiment in order to accommodate two separate seat pedestal bases. This is to accommodate shorter and taller boaters. In aluminum and fiberglass prior art boats, the seat pedestals are installed on top of the deck panels with no molded-in structures present to accommodate them. That is, the deck panels are secured over the top of a big, hollow void, giving enough room for the posts of the seat pedestals to extend into. In prior art rotational molded plastic boats, no such molded-in solution has been used for providing drainage of seat pedestal bases. Prior rotational molded plastic boats either use a prefabricated deck structure as in aluminum or FRP construction, or they allow water to fill up in the pedestal column.

Figure 6:
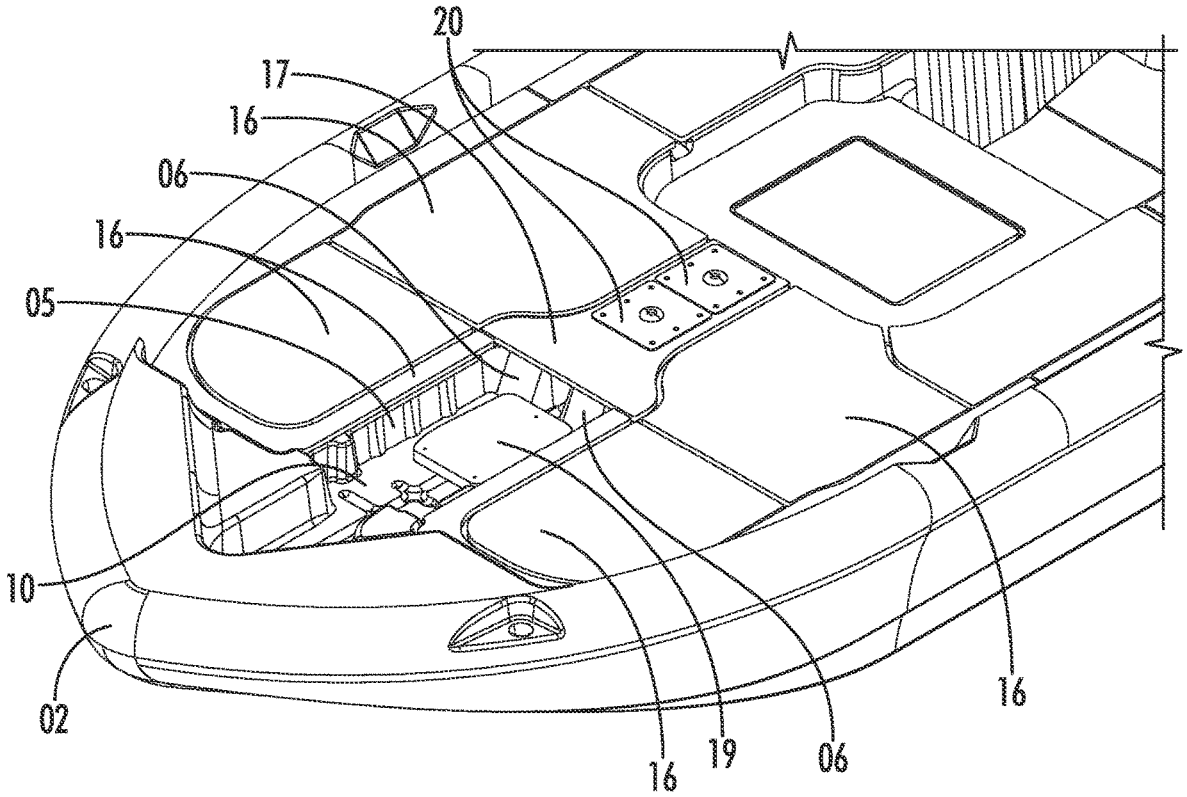
FIG. 6 is the same view as in FIG. 4, but additionally showing a notional trolling motor pedal installed along with the seat pedestal bases (shown installed on the deck panels).

In FIG. 6, the same isometric view as in FIG. 4 is depicted, but with a notional trolling motor pedal installed in the seat pedestal cavity 10, or inside the forward portion of the combined drain trench. In addition, two seat pedestal bases are shown installed onto the deck panel 17 covering the seat pedestal cavities 11. The notional trolling motor pedal is depicted generally by numeral 19, whereas the seat pedestal bases are depicted generally by numeral 20.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A drainage system for recess-mounted trolling motor pedal and seat pedestal base cavities in a rotational molded plastic power boat hull comprising:

a molded-in trolling motor pedal cavity in a forward deck portion of the boat hull sized for recess-mounting a trolling motor foot pedal in said trolling motor pedal cavity;

a molded-in seat pedestal base cavity in the forward deck portion aft of the trolling motor pedal cavity and sized to contain a recessed bushing of a seat pedestal base in said seat pedestal base cavity;

a molded-in drainage trench having a trench section connecting between the trolling motor pedal cavity and a forward end of the seat pedestal base cavity, and another trench section connecting to a rearward end of the seat pedestal base cavity and extending aft of the seat pedestal base cavity terminating in an opening where water in the molded-in trolling motor pedal cavity and seat pedestal base cavity can exit towards a bilge, said molded-in trolling motor pedal cavity, seat pedestal base cavity and drainage trench sections having a continuous side wall defined by one or more molded-in longitudinal and transverse walls, and a continuous bottom surface.

2. The drainage system of claim 1 additionally comprising another molded-in seat pedestal base cavity located aft of the trolling motor pedal cavity, said trench connecting between the trolling motor pedal cavity and both seat pedestal base cavities.

3. The drainage system of claim 2 wherein the trolling motor pedal cavity, seat pedestal base cavities, and trench are centered about a longitudinal axis of the rotational molded plastic power boat hull.

4. The drainage system of claim 2 additionally comprising a deck panel configured to be installed extending over the seat pedestal base cavities and trench to support the seat pedestal base in a position over one of the seat pedestal base cavities.

5. The drainage system of claim 4 additionally comprising a molded-in drainage channels comprised of a raised lip and cavity extending around at least a portion of a perimeter of the trolling motor pedal and seat pedestal base cavities which drainage channel collects water flowing off of the deck panel which is then channeled aft towards the bilge.

6. The drainage system of claim 4 additionally comprising one or more horizontal flat surfaces bordering the seat pedestal base cavities and trench to support the deck panel secured over the seat pedestal base cavities and trench.

7. The drainage system of claim 1 wherein the trolling motor pedal cavity has a depth such that the trolling motor foot pedal is flush with surrounding deck structure of the boat hull when mounted in the trolling motor pedal cavity.

8. The drainage system of claim 1 wherein the trolling motor pedal cavity, seat pedestal base cavity, and trench sections have the same depth.

9. The drainage system of claim 1 wherein the continuous bottom surface is flat.

10. The drainage system of claim 9 additionally comprising a stiffening rib in said continuous bottom surface.

11. A rotationally molded plastic power boat hull having a bow portion, a stern portion, a deck structure, and a bilge comprising:

a molded-in male cavity in the deck structure configured to accommodate recessed mounting of a trolling motor foot pedal;

first and second molded in male cavities in the deck structure configured to accommodate installation of seat pedestal bases;

the molded-in trolling motor pedal cavity positioned closer to the bow portion than the first and second molded-in seat pedestal base cavities; and a molded-in drainage trench including a trench section connecting between the trolling motor pedal cavity and the first seat pedestal base cavity, another trench section connecting between the first and second seat pedestal base cavities, and another trench section connected extending aft from the second seat pedestal base cavity and terminating in an opening through which water in the trolling motor pedal cavity and first and second seat pedestal base cavities can drain to a lower point in the hull;

wherein the trolling motor pedal cavity, first and second seat pedestal base cavities, and trench sections are defined by a combination of connecting longitudinal and transverse vertical walls in the deck structure.

12. The rotationally molded plastic power boat hull of claim 11 wherein trolling motor pedal cavity, first and second seat pedestal base cavities, and trench sections have a continuous bottom surface.

13. The rotationally molded plastic power boat hull of claim 12 wherein the trolling motor pedal cavity, first and second seat pedestal base cavities, and trench sections are longitudinally centered and aligned.

14. The rotationally molded plastic power boat hull of claim 13 additionally comprising a deck panel configured to be supported on the deck structure extending over at least one of the seat pedestal base cavities and to support a seat pedestal base.

15. A rotationally molded plastic power boat hull having a bow portion, a stern portion, a deck structure, and a bilge comprising:

a molded-in male cavity configured to accommodate recessed mounting of a trolling motor foot pedal;

another molded in male cavity configured to accommodate mounting of a seat pedestal base in the boat hull; and a molded-in drainage trench having a trench section in the deck structure connecting between the trolling motor pedal cavity and seat pedestal base cavity and configured to enable water in the trolling motor pedal cavity and seat pedestal base cavity to drain to the bilge;

said molded-in trolling motor foot pedal cavity and seat pedestal base male cavity and trench sections having a continuous side wall defined by one or more molded-in longitudinal and transverse walls, and a continuous bottom wall.

16. The rotationally molded plastic power boat hull of claim 15 wherein the trolling motor foot pedal and seat pedestal base male cavities and trench sections have the same depth.

17. The rotationally molded plastic power boat hull of claim 16 additionally comprising a stiffening rib in said continuous bottom surface.

18. The rotationally molded plastic power boat hull of claim 15 wherein the trench sections have a lesser width than the molded-in male cavities.

* * * * *